United States Patent [19]

Anderson

[11] Patent Number: 4,796,628

[45] Date of Patent: Jan. 10, 1989

[54] INFANT PACIFIER

[76] Inventor: Sanford J. Anderson, 10284 Nottingham Trail, Eden Prairie, Minn. 55344

[21] Appl. No.: 59,331

[22] Filed: Jun. 8, 1987

[51] Int. Cl.[4] ..... A61J 17/00

[52] U.S. Cl. ..... 128/360; 128/359

[58] Field of Search ..... 604/77, 174; 128/360, 128/359, 136, D26, 3–4, 9, 10, 12, 207.14, 207.17; 215/11 R, 11 E

[56] References Cited

U.S. PATENT DOCUMENTS

| | | | |
|---|---|---|---|
| 874 | 4/1808 | Brown | 128/360 |
| 1,656,833 | 1/1928 | Schutze . | |
| 2,824,561 | 2/1958 | Mueller . | |
| 3,187,746 | 6/1965 | Gerber | 128/359 |
| 3,363,630 | 11/1968 | Hines | 128/360 |
| 3,702,612 | 11/1972 | Schlesinger | 604/180 |
| 4,078,570 | 3/1978 | Frodrich et al. . | |
| 4,193,407 | 3/1980 | Edmark . | |
| 4,360,025 | 11/1982 | Edwards | 604/180 |
| 4,381,785 | 5/1983 | Robbins . | |
| 4,402,321 | 9/1983 | Berg . | |
| 4,447,164 | 5/1984 | Berndt . | |
| 4,545,378 | 10/1985 | Chrones . | |
| 4,554,919 | 11/1985 | Hubert . | |
| 4,715,379 | 12/1987 | McCormick | 128/360 |

*Primary Examiner*—Stephen C. Pellegrino
*Assistant Examiner*—Colleen Reilly
*Attorney, Agent, or Firm*—R. Lawrence Buckley

[57] ABSTRACT

A pacifier (10) suitable for use in conjunction with a gavage tube (37). A preferred pacifier (10) includes a guard (14) which forms a pair of grooves (40) and tube stays (32) suitable for receiving and cinching gavage tube (37). Another preferred feature is a flexible diaphragm (16) which is attached to the open end of nipple (12) of pacifier (10). Diaphragm (16) visibly deflects when and if nipple (12) is constructively sucked, thereby providing an indication of when gavage tube feeding can be abandoned in favor of bottle and/or breast feeding.

17 Claims, 2 Drawing Sheets

INFANT PACIFIER

TECHNICAL FIELD

The present invention relates generally to pacifiers and more particularly to pacifiers for use with premature infants.

BACKGROUND OF THE INVENTION

Pacifiers, occasionally called soothers or conforters, are well known. Pacifiers generally include a pliable nipple or teat which extends from one side of a guard or shield. The guard is usually made from relatively hard plastic, compared to the nipple, and is contoured to comfortably fit against the area adjacent a baby's mouth. The diameter of the guard is of sufficient magnitude to prevent it from wholly entering the child's mouth. Oftentimes a ring or handle extends from the side of the guard opposite from the nipple.

Pacifiers are used for a variety of purposes. As suggested by the name, pacifiers soothe or "pacify" an infant by providing an oral stimulation or distraction. They also aid in the infant's digestive and waste elimination processes, by stimulating salivation and peristalsis of the bowel. It has also been reported that babies provided with pacifiers are subjected to less stress, as measured by heart rate and breathing during painful medical procedures, e.g., blood sample drawing. Infants who suck a pacifier during blood drawing also seem to cry less. Also, it seems that babies who use pacifiers during gavage feeding gain more weight more quickly than babies without pacifiers. As a result, premature infants who use pacifiers spend less time in the intensive-care units and have lower hospital costs. Finally, appropriate use of a pacifier exercises the sucking muscles which are needed for bottle and breast feeding.

While the pacifier of the present invention can be used for infants generally, it is particularly intended for premature infants, or "preemies". Premature infants are generally defined as those which are 36 weeks old or younger and usually 2,000 grams or less. Due to their immaturity and diminutive stature, premature infants have special needs. For example, they are often incapable of eating normally, at least initially.

Depending on the premature infant's age, weight and development state, it may be necessary to initially feed him intravenously, using a Dexrose-based solution. Intravenous (IV) feeding is necessary up until the time the child's digestive system is sufficiently well developed to absorb enough calories to support the child's dynamic metabolism and at the same time promote growth and weight gain. Generally, IV feeding is indicated for preemies which are younger than about 34 weeks gestation.

While IV feeding may be necessary for a time, typically 1–3 days, it is imperative to utilize an infant's normal digestive process as soon as possible. The sooner a child is capable of digesting food, the sooner it can begin eating normally. An intermediate step between IV feeding and normal sucking and swallowing is gavage tube feeding. This method involves supplying a milk-based formula directly to the infant's stomach through a feeding tube which is threaded through the mouth and down the esophagus to the stomach. A bottle or bag of formula is attached to the upper end of the gavage tube. The formula slowly courses through the gavage tube directly into the infant's stomach.

Gavage tube feeding is considered superior to IV feeding because it involves the normal digestion of a nutritionally complete formula, and is a natural step toward normal eating. There are several disadvantages associated with gavage tube feeding, however. The gavage tube must be fed through the child's oropharynx and esophagus every time the child is fed. At best, this process can cause discomfort and gagging. At worst, the gavage feeding tube can be inadvertently inserted into the infant's trachea and lungs. If feeding solution is fed into a child's lungs, the infant can literally asphyxiate. But probably the major drawback of gavage tube feeding is that it bypasses normal sucking. The infant's sucking muscles are not exercised since food is fed directly to his stomach. Sucking is important because it encourages the production of saliva and digestive juices, which help digest the infant's food, and sucking also reinforces peristalsis of the bowel.

A gavage tube also precludes or significantly interferes with the use of traditional pacifiers. If a care giver wishes to provide the infant with a traditional pacifier and a gavage tube is in place, the gavage tube must first be removed.

Before an infant can progress from gavage tube feeding to normal breast or bottle feeding, it must be capable of "constructively" sucking and swallowing. Many premature infants are not capable of constructively sucking, at least initially. An infant is "constructively" sucking if it is actually creating a considerable negative pressure in its oral cavity or oropharynx. Such negative pressure must be produced in order to draw from a bottle or breast. It is difficult to tell whether an infant is constructively sucking merely by observing the infant's mouth and cheek movements while he is using a traditional pacifier. In fact, it has heretofore been effectively impossible to determine whether an infant is truly capable of constructively sucking without repeatedly providing it with a bottle or breast. Even if an infant is orally manipulating a traditional pacifier with what appears to be a normal sucking motion, in fact the infant may simply be "playing" with the pacifier rather than constructively sucking it. This may necessitate a burdensome trial and error process involving replacing the gavage tube with a bottle and observing the infant for constructive sucking and swallowing.

The applicant, a Board-Certified pediatrician, therefore perceives that a premature infant pacifier should accommodate gavage feeding, stimulate constructive sucking and provide means for determining when an infant is ready to progress from gavage tube feeding to normal sucking and eating. Also, a preemie pacifier should be of such a size and configuration that it is suitable for use with preemies as opposed to more mature infants.

Many pacifiers have been proposed. Unfortunately, prior art pacifiers are not well suited for the premature infant. U.S. Pat. No. 4,381,785, issued to L. Robins, for example, discloses a popular type of pacifier which includes a pliable nipple and a shield which is too large for use with a premature infant and precludes simultaneous use of a gavage tube. A similar pacifier is shown in U.S. Pat. No. 4,545,378, issued to A. Chrones. In addition, some prior art pacifiers include complex structures and functions which are impractical at best and hazardous at worst. For example, U.S. Pat. No. 4,193,407, issued to O. Edmark, discloses a pacifier having table salt and non-toxic dye in the nipple; U.S. Pat. No. 4,554,919 discloses an electronic pacifier; and U.S. Pat. No. 4,447,164 discloses a temperature responsive pacifier which includes a liquid crystal material within the nipple portion. In addition to their other faults, such pacifiers are too large for premature infants, and are not at all compatible with gavage tube feeding. Nor do such pacifiers provide any indication that the child is "constructively" sucking and ready to progress from gavage tube feeding to normal sucking. U.S. Pat. No. 2,824,561, issued to Mueller, discloses a combination infant pacifier and feeding device having a hollow, nipple-shaped body which can be connected at one end to a feeding bag and which can be sucked at its opposite nipple-shaped end. While this design might seem to be capable of accommodating simultaneous feeding and pacifying, clearly the child must be capable of normal feeding before this nipple can be used. An infant incapable of normal eating must use an IV tube or gavage tube, and use of the Mueller pacifier would be impossible.

Also, some care providers have used modified feeding nipples as pacifiers for premature infants. The feeding nipple is plugged with a cotton pledgelet and then the base of the nipple is sealed with a piece of tape to hold the cotton in place. Unfortunately, there may be some risk involved in using modified feeding nipples as pacifiers. In any event, such modified nipples still interfere with use of a gavage tube and make it difficult to tell whether an infant is constructively sucking.

The present invention addresses the problems associated with prior art pacifiers. In particular, the present invention is directed toward a safe, specifically-configured pacifier for the premature infant. A preferred pacifier according to the present invention accommodates gavage tube feeding and also indicates the presence of constructive sucking so that the care provider knows when to switch from gavage tube to normal bottle or breast feeding.

SUMMARY OF THE INVENTION

Accordingly, one embodiment of the invention is an infant pacifier suitable for use in conjunction with a gavage tube. The pacifier includes a nipple and a guard, wherein the guard forms a groove suitable for receiving the gavage feeding tube, whereby the pacifier and the gavage feeding tube can be used simultaneously and whereby the pacifier can be inserted and removed without disturbing the gavage tube.

In a preferred embodiment, a tube stay is included on the outer surface of the guard, wherein when the gavage tube is received by the groove and the tube stay, the gavage tube is cinched and directed along the guard outer surface.

A preferred embodiment includes a pair of diametrically-opposed grooves and a pair of diametrically-opposed L-shaped tube stays, wherein one each of the stays is proximate one each of the grooves, and wherein the gavage tube is received by either one of the grooves and the associated stay.

Another feature of a preferred pacifier embodiment is the ability to indicate the presence (or absence) of constructive sucking. A preferred pacifier having this feature includes a hollow nipple having a closed end suitable for sucking and an open end; a guard forming a nipple aperture suitable for receiving the open end of the nipple; and a diaphragm covering the open end of the nipple, whereby when the nipple is constructively sucked, the diaphragm noticeably deflects. Preferably, the diaphragm is arranged and configured to visibly deflect when the nipple is constructively sucked. A thin elastomeric diaphragm is suitable for this purpose.

Finally, a most preferred embodiment according to the invention is an infant pacifier which includes groove means for accommodating a gavage tube and means for detecting the presence of constructive sucking. Thus, a preferred infant pacifier includes a nipple; a suitably grooved guard including one or more tube stays; and a thin elastomeric diaphragm covering the open end of the nipple suitable for visibly deflecting when the nipple is constructively sucked.

Additional features and aspects of the invention are discussed below with reference to the attached drawings.

BRIEF DESCRIPTION OF THE DRAWINGS

A preferred embodiment of the invention will now be described with reference to the accompanying drawings, in which.

DETAILED DESCRIPTION OF PREFERRED EMBODIMENT

Figure 1:
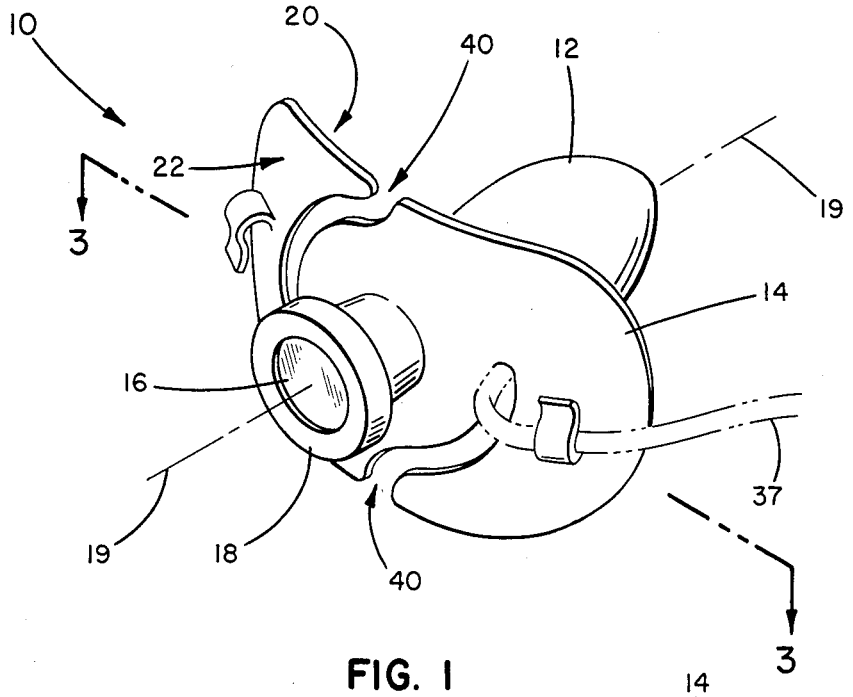
FIG. 1 is a perspective view of a preferred infant pacifier according to the invention, showing a gavage tube in phantom.
Figure 2:
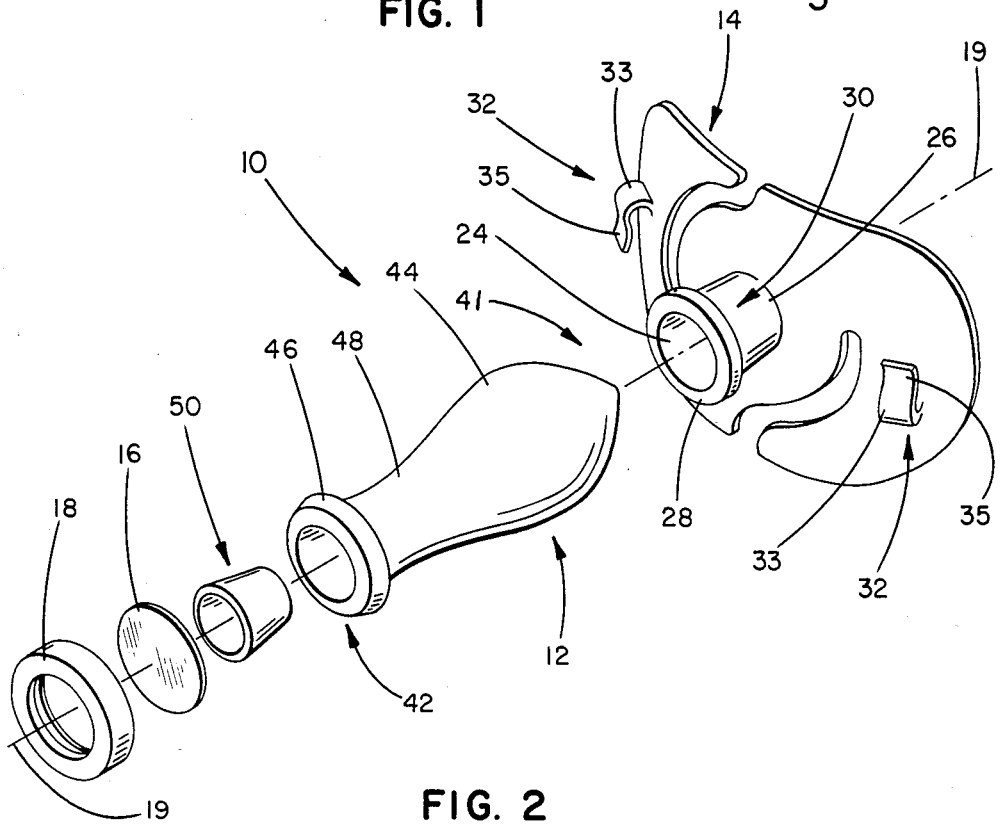
FIG. 2 is a perspective exploded view of the pacifier of FIG. 1.

Referring to the drawings, wherein like reference numerals designate like parts and assemblies throughout the several views, FIG. 1 shows a perspective view of a preferred premature infant pacifier 10 according to the invention. Pacifier 10 includes four major components, i.e., a nipple 12; guard 14; diaphragm 16; and a lock collar 18. These major components are coaxially aligned along a nipple axis 19, and pacifier 10 is symmetrical with respect thereto. Guard 14 has an inner surface 20 from which nipple 12 extends, and an outer surface 22. Guard 14 also forms a central nipple aperture 24 shown in FIG. 2. Diaphragm 16 covers the open end of the nipple 12 and lock collar 18 seals diaphragm 16 and nipple 12 to guard 14 and thereby completes the assembly. Each of the four major components of pacifier 10 is described in detail below.

GUARD 14

Figure 3:
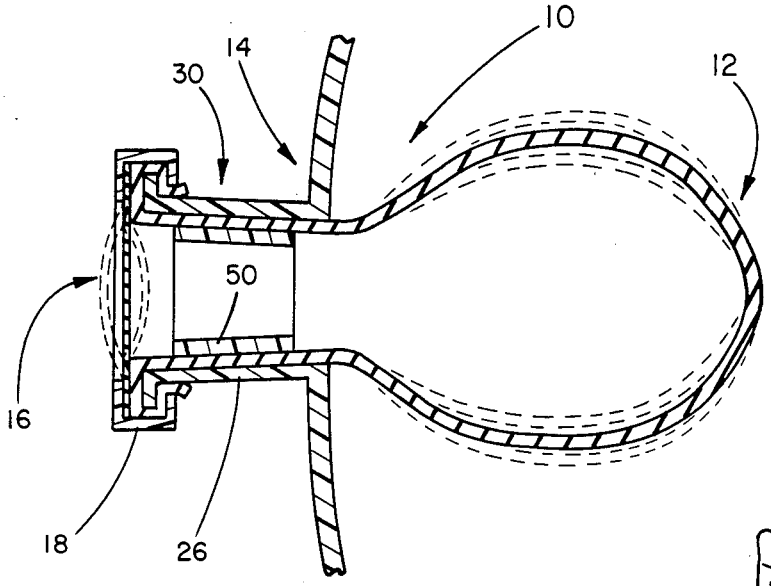
FIG. 3 is a side sectional view of the pacifier of FIG. 1, taken substantially along line 3—3.
Figure 4:
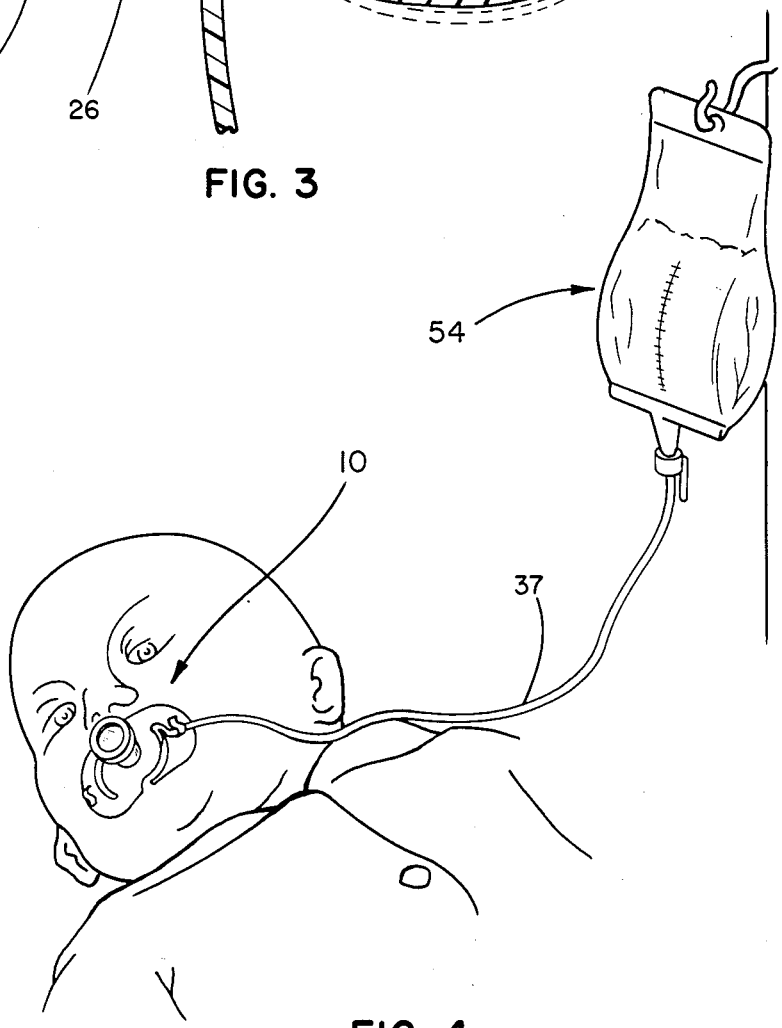
FIG. 4 is a perspective view of a pacifier and gavage feeding system including the pacifier of FIG. 1.

The overall shape of guard 14, as viewed along axis 19, is preferably a symmetrical hourglass, elliptical or obround shape so that pacifier 10 can be used in either of two orientations, i.e., as shown in FIG. 4 or rotated 180° relative thereto. As noted above, guard 14 includes an inner surface 20 and an outer surface 22. Inner surface 20, as shown in FIG. 3, is concave to fit comfortably around an infant's mouth whereas the outer surface 22 is convex.

Inner surface 20 is smooth but for nipple 12 extending perpendicularly therefrom. Outer surface 22, on the other hand, carries a central shoulder 30 and a pair of diametrically-opposed tube stays 32. Each tube stay 32 is somewhat L-shaped, having a relatively short inwardly-curved portion 33 extending integrally from outer surface 22 and substantially perpendicular thereto, and a relatively longer outwardly-curved portion 35 connected to the relatively short portion such that it is roughly parallel to the outer surface 22. Each tube stay 32 forms a throat or pinch area roughly at the inflection point between the inwardly and outwardly curved portions 33 and 35, respectively. The width of the throat is slightly smaller than the outside diameter of a standard gavage tube 37, shown in phantom in FIG. 1. Thus, gavage tube 37 must be squeezed through the throat area but is only lightly gripped in the cylindrical area formed by portion 33 such that gavage tube 37 is held but not pinched off.

In addition to stays 32, guard 14 forms a pair of grooves or channels 40. The width of grooves 40 is about equal to the outside diameter of gavage tube 37, i.e., 2–3 mm, and one each of the grooves 40 is located between shoulder 30 and one each of the tube stays 32. Therefore, as shown in FIGS. 1 and 4, a groove 40 and associated tube stay 32 can cooperatively cinch gavage tube 37 and guide it to the outer edge of guard 14.

As shown in FIG. 3, shoulder 30 includes a hollow conical portion 26 which extends from the outer surface 22 of guard 14. The smaller end of conical portion 26 is proximate guard outer surface 22 and an annular ring portion 28 having a larger outside diameter than conical portion 26 is situated at the distal end of conical portion 26. The diameter of the nipple aperture 24 formed by shoulder 30 is preferably about 8 millimeters at ring portion 28, tapering down slightly toward the smaller end of conical portion 26.

NIPPLE 12

As noted above, nipple 12 extends from inner surface 20 of guard 14. In the exploded view of FIG. 2, however, nipple 12 is shown adjacent outer surface 22. Nipple 22 is so shown because of the nature in which the components of pacifier 10 are assembled.

Nipple 12 is preferably a hollow molded latex rubber element having a closed end 41 and an open end 42. Adjacent closed end 41 is a bulb portion 44 which is somewhat orthodontically asymmetrical, like the well-known NUK® nipple, but includes a convex underside rather than the substantially "flat" underside of a NUK® nipple. The Applicant has found that infants tend to spit out nipples having flat undersides, apparently because their tongues can push against this flat inclined surface to generate an outward axial thrust on the pacifier. In fact, many infants and their caregivers elect to use such nipples in an upside-down manner to circumvent this problem. The shape of bulb portion 44 is such that the top and bottom surfaces thereof are somewhat convex to conform to an infant's tongue, thereby minimizing the pacifier spitting problem discussed above.

Forming the open end 42 is a circular bead 46. Bead 46 is a slightly thickened ring which can fit on the end of shoulder 30 at the nipple aperture 24. As shown in FIG. 3, bead 46 is configured to conform around the ring 28 at the distal end of conical portion 26 of shoulder 30. Thus, a sealing contact is made between nipple 12 and shoulder 30.

Extending between bulb portion 44 and bead portion 46 of nipple 12 is a smaller diameter hollow neck portion 48. Neck portion 48 resides substantially within shoulder 30 when pacifier 10 is assembled, as shown in FIG. 3.

WEDGE 50, DIAPHRAGM 16 AND LOCK COLLAR 18

A hollow frusto-conical wedge 50 is inserted within neck portion 48 to prevent nipple 12 from being separated from guard 14. The solid angle of wedge 50 is substantially the same as that of conical portion 26 of shoulder 30, thereby ensuring that wedge 50 will force nipple neck 48 into tight engagement with the inner surface of conical portion 26. Wedge 50 not only locks nipple 12 to guard 14, it also prevents neck 48 from collapsing when the pacifier 10 is constructively sucked, and allows the pressure changes from the sucking to be transmitted to diaphragm 16 at the open end 42 of the nipple 12.

Diaphragm 16 is preferably a circular piece of elastomeric material sized to fit over the open end 42 of nipple 12. As shown in FIG. 3, the radius of diaphragm 16 is about the same as the outside radius of bead 46 such that diaphragm 16 seals against bead 46 when pacifier 10 is assembled. The thickness and diameter of diaphragm 16 are selected to allow diaphragm 16 to visibly deflect when nipple 12 is constructively sucked. The deflection of diaphragm 16 is shown in FIG. 3: it deflects inward, toward guard 14, when the infant constructively sucks on nipple 12 and thereby increases its internal volume, and deflects outward, away from guard 14, if and when the child reduces the internal volume of nipple 12 by biting it, for example. It should be noted that diaphragm 16 could be fitted with a transducer, e.g., strain gauge, suitable for measuring the deflection of the diaphragm. In other words, it's not absolutely necessary that diaphragm 16 visibly deflect, but there must be some means for detecting the presence of constructive sucking.

Completing the assembly is lock collar 18. As shown in the drawings, collar 18 is ring-like in nature, forming a viewing aperture for diaphragm 16. Collar 18 is preferably plastic and has a U-shaped edge suitable for snapping over the distal ring 26 of guard 14. When collar 18 is in place, diaphragm 16 is pressed into sealing engagement with nipple bead 46, and bead 46 is squeezed into tight conformance with the distal ring 26 of guard 14. Thus the internal volume of nipple 12 is sealed and diaphragm 16 will visibly deflect, preferably, as a result of pressure changes created during constructive sucking.

OPERATION

Operation of the system can now be summarized. As shown in FIG. 4, pacifier 10 can be used with a gavage bag 54 and tube 37. To do so, bag 54 is filled with formula and appropriately elevated above the infant. Tube 37 is attached to the bottom of bag 54 and threaded down through the infant's esophagus and into his stomach. Then, pacifier 10 can be used simply by inserting nipple 12 into the infant's mouth and at the same time placing tube 37 within one of the grooves 40 formed by guard 14. Tube 37 can then be cinched in place by slipping it into the corresponding tube stay 32.

If it is necessary to remove pacifier 10 after tube 37 has been inserted into the infant's esophagus, tube 37 is simply slipped out of the stay 37 and corresponding groove 40. That is, it is not necesssary to remove tube 37 from the infant's esophagus merely to remove the pacifier. Diaphragm 16 provides a visual indication that the infant has learned to constructively suck pacifier 10, by visibly deflecting inwardly and outwardly. When the magnitude and frequency of sucking are adequate, gavage feeding is no longer necessary as the infant should be able to draw sustenance from a bottle or breast.

A preferred embodiment of the invention is described above. Those skilled in the art will recognize that many embodiments are possible within the scope of the invention. Variations and modifications of the various parts and assemblies can certainly be made and still fall within the scope of the invention. Thus, the invention is limited only to the apparatus and method recited in the following claims, and equivalents thereto.

I claim:

1. An infant feeding and pacifying system comprising:
(a) a gavage container;
(b) a gavage tube connected to the gavage container; and
(c) an infant pacifier comprising:
(i) a nipple; and
(ii) a guard having an inner surface and an outer surface, wherein the nipple is connected to the guard and extends from the inner surface thereof, and wherein the guard forms groove means for receiving the gavage feeding tube, whereby the pacifier and the gavage feeding tube can be used simultaneously and whereby the pacifier can be inserted and removed without disturbing the gavage tube.

2. The system of claim 1, wherein the groove means comprises a groove extending inwardly from one edge of the guard, and the pacifier further comprises a tube stay extending from the outer guard surface, wherein when the tube is received by the groove and the stay, the tube is cinched and directed along the guard outer surface.

3. The system of claim 1, wherein the nipple is centrally located on the guard and the groove means comprises a pair of grooves extending inwardly from opposite edges thereof on either side of the nipple, wherein either groove can receive the gavage feeding tube.

4. The system of claim 3, further comprising a pair of tube stays extending from the guard outer surface, wherein one each of the stays is proximate one each of the grooves, wherein when the tube is received by either one of the grooves and the associated stay the tube is cinched and directed along the guard outer surface.

5. The system of claim 4, wherein each stay is substantially L-shaped and is located on the opposite side of the associated groove from the nipple, whereby each groove and associated stay cooperate to guide the tube generally away from the nipple.

6. The system of claim 5, wherein the stays are diametrically-opposed and the grooves are diametrically-opposed.

7. The system of claim 6, wherein the grooves have outermost ends at opposite edges of the guard and innermost ends toward the center of the guard, wherein the stays and the groove innermost ends are substantially aligned with the nipple.

8. The system of claim 5, wherein the stays and grooves are symmetrically arranged about the centerline of the nipple.

9. The system of claim 4, wherein the stays are substantially L-shaped and face in opposite directions.

10. An infant pacifier comprising:
(a) a nipple having an open interior, a closed end suitable for sucking and an open end;
(b) a guard forming a nipple aperture for receiving the open end of the nipple; and
(c) a diaphragm sealing the open end of the nipple and in fluid communication with the interior of the nipple, wherein when the nipple is constructively sucked pressure changes within the interior of the nipple cause the diaphragm to noticeably deflect.

11. The pacifier of claim 10, wherein the diaphragm is arranged and configured to visibly deflect when the nipple is constructively sucked.

12. The pacifier of claim 11, wherein the diaphragm comprises a thin elastomeric disk.

13. The pacifier of claim 10, wherein the guard has an inner surface and an outer surface and comprises a shoulder extending from the outer surface thereof about the nipple aperture; and wherein the pacifier comprises a lock collar for sealably pressing the diaphragm and the open end of the nipple against the guard shoulder.

14. The pacifier of claim 10, further comprising an apertured wedge suitable for insertion into the open end of the nipple for wedging the nipple within and against the guard shoulder.

15. An infant pacifier suitable for use in conjunction with a gavage feeding tube, comprising:
(a) a hollow nipple having a closed end suitable for sucking and an open end;
(b) a guard having an inner surface and an outer surface; wherein the guard forms a nipple aperture for receiving the open end of the nipple, and wherein the guard forms a pair of grooves extending inwardly from opposite edges thereof on either side of the nipple suitable for receiving the gavage feeding tube, whereby the pacifier and the gavage feeding tube can be used simultaneously and whereby the pacifier can be inserted and removed without disturbing the gavage tube;
(c) a pair of substantially L-shaped tube stays extending from the outer surface of the guard, wherein one each of the stays is proximate one each of the grooves, whereby when the tube is received by either one of the grooves and the associated stay the tube is cinched and directed along the guard outer surface;
(d) a shoulder extending from the outer surface of the guard about the nipple aperture;
(e) an apertured wedge suitable for insertion into the open end of the nipple for wedging the nipple within and against the guard shoulder;
(f) a diaphragm covering the open end of the nipple, whereby when the nipple is constructively sucked the diaphragm visibly deflects; and
(g) a lock collar for sealably pressing the diaphragm and the open end of the nipple against the guard shoulder.

16. An infant feeding and pacifying system comprising:
(a) a gavage bag;
(b) a gavage tube connected to the bag; and
(c) an infant pacifier comprising:
(i) a hollow nipple having a closed end suitable for sucking and an open end;
(ii) a guard having an inner surface and an outer surface, wherein the guard forms a nipple aperture for receiving the open end of the nipple, and wherein the guard forms a pair of grooves extending inwardly from opposite edges thereof on either side of the nipple suitable for receiving the gavage feeding tube, whereby the pacifier and the gavage feeding tube can be used simultaneously and whereby the pacifier can be inserted and removed without disturbing the gavage tube;

(iii) a pair of substantially L-shaped tube stays extending from the outer surface of the guard, wherein one each of the stays is proximate one each of the grooves, whereby when the tube is received by either one of the grooves and the associated stay the tube is cinched and directed along the guard center surface;

(iv) a shoulder extending from the outer surface of the guard about the nipple aperture;

(v) an apertured wedge suitable for insertion into the open end of the nipple of wedging the nipple within and against the guard shoulder;

(vi) a diaphragm covering the open end of the nipple, whereby when the nipple is constructively sucked the diaphragm visibly deflects; and (vii) a lock collar for sealably pressing the diaphragm and the open end of the nipple against the guard shoulder.

17. A method for simultaneously pacifying an infant and feeding formula to the infant, comprising:

(a) selecting a gavage feeding system comprising means for containing the formula and a gavage tube connected thereto;

(b) threading the gavage tube through the infant's esophagus and into his stomach;

(c) causing formula to flow from the formula containing means through the gavage tube and into the infant's stomach;

(d) selecting an infant pacifier comprising:

(i) a nipple; and (ii) a guard having an inner surface and an outer surfsace, wherein the nipple is connected to the guard and extends from the inner surface thereof, and wherein the guard forms groove means for receiving the gavage feeding tube; and (e) inserting the nipple into the infant's mouth and placing the gavage tube within the groove means without withdrawing the gavage tube from the infant, whereby the pacifier and the gavage feeding tube are used simultaneously.

* * * * *